United States Patent [19]

Jensen

[11] 4,188,280

[45] Feb. 12, 1980

[54] METHOD FOR REMOVING ARSENIC FROM SHALE OIL

[75] Inventor: Harbo P. Jensen, San Rafael, Calif.

[73] Assignee: Chevron Research Company, San Francisco, Calif.

[21] Appl. No.: 945,750

[22] Filed: Sep. 25, 1978

[51] Int. Cl.[2] ..... C10G 23/00; C10G 37/06

[52] U.S. Cl. ..... 208/53; 208/251 H

[58] Field of Search ..... 208/50, 53, 251 H

[56] References Cited

U.S. PATENT DOCUMENTS

| | | | |
|---|---|---|---|
| B 438,916 | 1/1976 | Rosynek et al. | 208/253 |
| 2,910,434 | 10/1959 | Hess et al. | 208/251 R |
| 2,911,353 | 11/1959 | Watts et al. | 208/50 |
| 3,132,088 | 5/1964 | Beuther et al. | 208/67 |
| 3,804,750 | 4/1974 | Myers et al. | 208/251 H |
| 3,876,533 | 4/1975 | Myers | 208/251 H |
| 3,933,625 | 1/1976 | Myers | 208/253 |
| 3,947,347 | 3/1976 | Mitchell | 208/251 H |
| 3,954,603 | 5/1976 | Curtin | 208/253 |
| 4,003,829 | 1/1977 | Burger et al. | 208/253 |
| 4,029,571 | 6/1977 | Curtin | 208/251 H |
| 4,046,674 | 9/1977 | Young | 208/251 H |
| 4,051,022 | 9/1977 | Myers et al. | 208/253 |

OTHER PUBLICATIONS

Curtin et al., "Arsenic and Nitrogen Removal During Shale Oil Upgrading", A.C.S. Div Fuel Chem. No. 23(4), 9/10/78, pp. 18–29.

*Primary Examiner*—Herbert Levine

*Attorney, Agent, or Firm*—D. A. Newell; R. H. Davies; M. K. Bosworth

[57] ABSTRACT

A combination process for reducing the soluble arsenic content of shale oil comprising thermally dearsenating the shale oil to make an aged shale oil, coking at least a portion of the aged shale oil, and catalytically hydroprocessing at least a portion of the coker distillate to produce a shale oil product having a low soluble arsenic content.

8 Claims, No Drawings

METHOD FOR REMOVING ARSENIC FROM SHALE OIL

BACKGROUND OF THE INVENTION

This invention relates to processing shale oil, and in particular to processing shale oil to reduce the arsenic content. Specifically, the invention relates to treating shale oil by a combination of processes-- thermal dearsenation, coking and catalytic hydroprocessing.

Most shale oils produced by conventional retorting processes contain levels of contaminants, such as arsenic, which tend to interfere with subsequent refining or catalytic hydroprocessing operations, such as hydrogenation, denitrogenation and desulfurization. Even if the shale oil is employed directly as a fuel, removal of such contaminants may be desirable from an environmental standpoint. Thus, it is desirable that contaminants such as arsenic be removed, or reduced to low levels, before the shale oil is further processed or used as fuel.

Previous methods for removing arsenic from hydrocarbonaceous oils include contacting raw shale oil with a dearsenation catalyst, such as oxides or sulfides of nickel, cobalt or iron, at an elevated temperature and usually under hydrogen pressure; see, for instance, U.S. Pat. Nos. 3,876,533; 3,933,624; 3,954,603; 4,003,829; 4,046,674; and 4,051,022.

It has also been recognized in U.S. Pat. No. 4,029,571 that arsenic can be removed from shale oil by heat soaking or visbreaking the oil long enough to form a suspended precipitate which must be subsequently mechanically separated from the oil. The oil may also be visbroken and a portion of the visbroken oil catalytically hydrogenated.

In other uses, a thermal treating step has been employed to remove various metallic contaminants from petroleum hydrocarbons, as has been described in U.S. Pat. No. 2,910,343. This reference discloses removal of up to 26 various trace metals, but not arsenic, from a petroleum crude oil feed by non-catalytically reacting the feed with hydrogen in the presence of an inert packing material to form a treated oil of reduced metal content and a solid metal-containing residue. Although the packing may retain a portion of the residue, this reference requires that the treated oil and the remaining residue must be separated by means such as filtration and settling, which are time-consuming and prone to equipment failures. U.S. Pat. No. 3,947,374 discloses removal of the same metals from a hydrocarbon feed by contacting the feed with hydrogen and an inert packing material having a specified pore diameter range to deposit the contaminants on the inert material. U.S. Pat. No. B438,916 discloses demetallation (nickel, vanadium, iron, copper, zinc or sodium but not arsenic) of a residual petroleum fraction by contacting the oil with a refractory oxide in the absence of added hydrogen. These references do not concern arsenic removal or pour point reduction, nor do they recognize that the thermally treated oil is relatively difficult to hydroprocess when compared with the untreated shale oil. Further, they do not suggest a way to improve the hydrogen processability of the oil once it has been thermally treated.

Other methods for treating hydrocarbonaceous oil include visbreaking oil, solvent deasphalting the visbroken oil, and contacting the resulting visbroken deasphalted oil with hydrogen in the presence of a catalyst, as is described in U.S. Pat. No. 3,132,088. In U.S. Pat. No. 2,975,121 there is described a process for removing metals from an asphaltic oil in which the oil is heat-soaked with hydrogen to form a metals-containing precipitate in the oil, and metals-containing oil is solvent deasphalted to remove the metals in the asphaltene fraction.

A combination of visbreaking shale oil followed by hydrogenation of the vapor or lower-boiling portion of the oil and combining the hydrogenated portion with the liquid or higher-boiling portion is taught in U.S. Pat. Nos. 3,523,071 and 3,738,931 as a method of reducing the pour point.

It has also been suggested by Curtin et al in *Arsenic and Nitrogen Removal During Shale Oil Upgrading,* ACS Div., Fuel Chem. No. 23 (4), 9/10-15/78., to treat raw shale oil by coking it, followed by catalytic hydrodenitrogenation of the coker distillate or a blend of raw shale oil and coker distillate. In this process, however, higharsenic coke distillate was found to have a lower denitrogenation rate than a high-arsenic blend of raw shale oil with coker distillate. This indicates that the coker distillate is more difficult to hydroprocess than raw shale oil.

SUMMARY OF THE INVENTION

This invention is a combination process for removing soluble arsenic from shale oil. A shale oil containing more than 4, and preferably more than 8, ppmw soluble arsenic is first thermally dearsenated to remove a portion of the arsenic from the oil. However, this step makes resulting aged shale oil more difficult to catalytically hydroprocess. Coking at least a portion of the aged shale oil will remove soluble arsenic from the oil and, surprisingly, eliminate the adverse effects that the thermal dearsenation step causes. The coker distillate is then catalytically hydroprocessed to form a shale oil product having less than 1 ppmw soluble arsenic.

In accordance with an embodiment of the present invention, there is provided a method for producing a hydroprocessed shale oil product from a shale oil feedstock contaminated with more than 4 ppmw arsenic in the form of at least one soluble arsenic compound, which comprises (a) forming an aged shale oil having arsenic content lower than that of the feedstock by contacting the feedstock with a porous solid contact material at a temperature from 149° to 510° C. (300°-950° F.), at a liquid hourly space velocity from 0.1 to 60 volumes of liquid per hour per volume of contact material, and a pressure sufficient to maintain said feedstock in substantially liquid phase, whereby a portion of the arsenic is deposited upon said contact material; (b) forming a coker distillate having an arsenic content lower than that of the aged shale oil and an arsenic-containing coke by coking at least a portion of the aged shale oil; and (c) forming the shale oil product having less than 1 ppmw soluble arsenic and a higher hydrogen-to-carbon ratio than the feedstock by catalytically reacting at least a portion of the distillate from step (b) at an elevated temperature with hydrogen in the presence of a hydroprocessing catalyst.

DETAILED DESCRIPTION OF THE INVENTION

The feedstock for the present invention is a shale oil which contains soluble arsenic in amounts of over 4 ppm by weight, and preferably above 8 ppmw and more preferably from 20 to 100 ppm or more by weight. The shale oil will frequently also contain at least 10 ppmw soluble iron, and preferably from 30 to 500 ppm or more by weight. The levels of arsenic and iron contaminatns in a given shale oil will, of course, depend upon the origin of the oil and upon the particular retorting process and conditions used to remove it from the shale. "Soluble arsenic" includes compounds and ions of arsenic which are soluble in the feedstock. "Soluble iron" includes compounds and irons of iron which are soluble in the feedstock. The shale oil feedstock may be a whole shale oil or a fraction thereof.

The thermal dearsenation step is carried out by bringing the shale oil feedstock to a temperature from 149° to 510° C. (300° to 950° F.) to precipitate a portion of the soluble arsenic in the oil onto the surface of a porous solid contact material. A preferred temperature range is from 149° to ;b 427° C. (300° to 800° F.) and below the point of significant thermal decomposition of the oil, and still more particularly from 316° to 399° C. (600° to 750° F.) and below the point of significant thermal decomposition. At these temperatures, arsenic will precipitate from the oil without the oil undergoing cracking or visbreaking, as is explained in detail in my copending application U.S. Ser. No. 891,567, filed Mar. 29, 1978, and entitled "Method for Lowering the Pour Point of a Shale Oil", the description of which is incorporated herein by reference. Also, at these temperatures the pour point of the shale oil generally will be reduced, usually by at least 5.6° C. (10° F.) compared with that of the feedstock. A temperature below the point of significant thermal decomposition of the shale oil means that substantially no cracking or visbreaking occurs and less than 1 or 2%, by weight of the oil, of methane or ethane gas will be formed during the thermal dearsenation step.

The thermal dearsenation will be carried out for a time sufficient for an arsenic-containing precipitate to form upon the contact material. The optimal time will depend upon the compositional origin of the particular oil, and can be determined by appropriate runs using the oil. The shale oil should contact the contact materials at a liquid hourly space velocity from 0.1 to 60, and preferably from 0.5 to 20.

The thermal dearsenation step may be carried out either in the presence or absence of added hydrogen. The presence of hydrogen at a hydrogen partial pressure from 3.4 to 340 atm gauge (50 to 5000 psig), and preferably from 34 to 130 atm gauge (500 to 2000 psig), leads to more arsenic removal, but increases the initial cost of the vessel in which thermal dearsenation is carried out. When the thermal dearsenation step is carried out in the absence of added hydrogen, the pressure may range from 0 to 340 atm gauge (0–5000 psig), and preferably from 0 to 34 atm gauge (0–500 psig).

The porous solid contact material used in the present invention can be any shape or size suitable for use as a contact material, for example, pellets, spheres or rods ranging in size from 1/32" to 3" in diameter or length. Preferred contact materials are non-catalytic with respect to arsenic removal and include activated carbon, silica, alumina or other inorganic oxides, spent catalysts, naturally occurring clays such as fuller's earth, kieselguhr, pumice or bauxite. Bauxite is especially preferred. Sufficient contact material should be present for the precipitate to form on it and not remain suspended in the oil.

As the shale oil feedstock is thermally dearsenated, the soluble arsenic in the oil will precipitate on the contact material, leaving an aged shale oil which may contain as little as 3–15 ppmw soluble arsenic but less than that in the feedstock if hydrogen was not present, and, if hydrogen is present, as little as 1 to 13 ppm soluble arsenic but less than that in the feedstock. When iron is present in the feedstock, the precipitate will also contain iron and the aged shale oil will have less soluble iron than the feedstock.

After the shale oil has been thermally dearsenated to form an aged shale oil, at least a portion of it is subject to a coking operation. Coking is a well-known thermal cracking process for converting an oil into distillate and coke. Any suitable coking method, for example, delayed coking or fluid coking, may be used in the method of the present invention. Typically, coking involves heating an oil to a temperature from 339° to 1093° C. (750° to 2000° F.) at a pressure of atmospheric or above, preferably, from atmospheric to 5 atm gauge. Either all of the aged shale oil may be coked, or the aged shale oil can be fractionated and just the heavier portion of the oil coked and the coker distillate hydroprocessed. If desired, the lighter portion of the aged shale oil can be mixed with the distillate from the coker and the mixture hydroprocessed.

The coking step will further reduce the amount of soluble arsenic in the shale oil, often by as much as ½ to ⅓ of the arsenic in the aged shale oil. The thermal dearsenation step has the advantage of removing much of the solube arsenic from the shale oil so that it will not concentrate in the coke. In addition, the coker distillate will have a lower arsenic content if the shale oil is first thermally dearsenated.

Aged shale oil is more difficult to hydroprocess than shale oil which has not been thermally treated. However, after being coked, the susceptibility of both treated and raw shale oils to hydroprocessing is improved. Both oils give approximately the same yield of coker distillate, and both coker distillates hydroprocess equally well, and thus coking nullifies the undesirable effects of the thermal dearsenating. The effect of coking on the thermally dearsenated shale oil is surprising because the art does not recognize that the thermal dearsenation step makes shale oil more difficult to catalytically hydroprocess, nor that coking will remove the disadvantage.

In the catalytic hydroprocessing step, the aged and coked shale oil is hydrogenated to increase the hydrogen-to-carbon ratio, and to remove still more of the soluble arsenic in the oil. Preferably, one or more of the iron, sulfur or nitrogen contaminants will also be removed from or reduced in concentration in the oil during the catalytic hydroprocessing step. One or more of the following reactions will occur during the hydroprocessing: hydrodearsenation, hydrodemetallation, hydrodesulfurization, hydrodenitrogenation, hydrogenation of olefins and aromatics, and hydrocracking. The catalytic hydroprocessing will be carried out in a conventional manner at conventional conditions including a temperature from 204° to 588° C. (400° to 1000° F.), preferably 316° to 482° C. (600° to 900° F.), a hydrogen partial pressure from 3.4 to 204 atm gauge (50 to 3000 psig), and preferably from 20.4 to 102 atm gauge (300 to 1500 psig), and a liquid hourly space velocity (volumes of oil per hour per volume of catalyst) from 0.1 to 30, perferably from 0.5 to 10.

Hydroprocessing catalysts are well know to the art and include catalysts containing a combination of Group VI metal or metals (e.g., chromium, molybdenum and tungsten) with Group VIII metal or metals (e.g., iron, nickel and cobalt), with or without additional metals, such as those in Group IV, and a carrier material. A preferred catalyst contains cobalt-molybdenum on a silica-alumina support.

At least a portion of the coker distillate will be catalytically hydroprocessed, and the resulting product shale oil will contain less than 1 ppmw soluble arsenic.

EXAMPLES

In order to more fully illustrate the method of the present invention, the following specific examples, which are in no sense intended to limit the present invention, are presented:

EXAMPLE 1

A sample of raw shale oil is thermally dearsenated at 399° C. (750° F.) over a carbon extrudate at a liquid hourly space velocity of 1 and a nitrogen pressure of 13.6 atm gauge (200 psig). Analyses of the raw and dearsenated shale oil are shown in Table I. The thermal dearsenation lowers the soluble arsenic and iron contents of the oil, does not affect the nitrogen and sulfur content, but increases the $C_7$ insoluble and Ramsbottom Carbon contents of the oil, which means an increase in the asphaltene content. Even though the nitrogen content is similar for both oils, thermal dearsenation makes the nitrogen-containing compounds more refractory and, thus, the nitrogen more difficult to remove. This expectation was confirmed by the higher rate constant for nitrogen removal calculated for the raw shale oil (2.4) than for the thermally dearsenated oil (1.8) after hydroprocessing the oils over a nickel-molybdenum-titanium on silica-alumina catalyst at 416° C. (780° F.), 143 atm $H_2$ gauge (2100 psig), LHSV=1, and 2492 $m^3/H_2$ (STP) per $m^3$ oil.

Samples of raw shale oil and thermally dearsenated shale oil are coked to produce coke and a coker distillate having the properties and at the conditions set forth in Table I. However, the data show that both oils behave similarly when coked and that the yields of coke and distillate are equivalent (taking into account the different distillate end points). It would be expected from the higher $C_7$ insoluble and Ramsbottom Carbon amounts that the coke yield would be higher for the thermally dearsenated shale oil. Thus, the similarity in yields is surprising. Coking also unexpectedly eliminates any adverse effects that the thermal dearsenating had on the hydroprocessability of shale oil, as is shown by the similar rate constants for nitrogen removal for both coker distillates. The nitrogen removal rate constant is slightly higher for the dearsenated shale oil coker distillate than for the raw shale oil coker distillate, which is to be expected from the lower coker distillate end point for the dearsenated shale oil. One effect of coking both oils is that arsenic and iron are concentrated in the coke, and the advantage to first thermally dearsenating the shale oil is that much of the arsenic and some of the iron will be removed in the dearsenation step, thus allowing production of a less contaminated and, therefore, more valuable coke. The thermal dearsenation step becomes more advantageous the higher the initial concentrations of arsenic and iron are in the raw shale oil.

Samples of coker distillate from raw shale oil and thermally dearsenated shale oil having properties similar to those shown in Table I are hydroprocessed over a nickel-molybdenum-titanium on silica-alumina catalyst at 416° C. (780° F.), 143 atm $H_2$ gauge (2100 psig), LHSV=1, and 2492 $m^3$ $H_2$ (STP) per $m^3$ oil. The hydroprocessed oils had similar properties, as shown in the analyses listed in Table I.

As a comparison, additional samples of the previously analyzed raw shale oil and dearsenated shale oil are hydroprocessed at the conditions listed above, and the results are shown in Table I. The data show that the hydroprocessed oils contain more arsenic than the hydroprocessed coker distillates, as well as more sulfur, nitrogen, $C_7$ insolubles and Ramsbottom Carbon. The arsenic and iron that are removed from the uncoked oils by hydroprocessing (As from 16 and 8 ppm to 0.01 and 0.03 ppm, and Fe from 52 and 38 ppm to <3 and <3 ppm) are deposited on the catalyst, greatly speeding its deactivation compared with hydroprocessing thermally dearsenated and coked shale oil (As from 4.7 ppm to <0.01 ppm).

EXAMPLE 2

In a series of bench-scale reactor tests, various raw shale oils were contacted at various thermal dearsenating conditions with various contact materials to produce shale oil products. Analyses of the feeds and products and the thermal deasphalting conditions are listed in Table II.

TABLE I

| | | | COKER DISTILLATE FROM | | HYDROPROCESSED COKER DISTILLATE FROM | | HYDROPROCESSED (BUT NOT COKED) | |
|---|---|---|---|---|---|---|---|---|
| | Raw Shale Oil | Dearsenated Shale Oil | Raw Shale Oil | Dearsenated Shale Oil | Raw Shale Oil | Dearsenated Shale Oil | Raw Shale Oil | Dearsenated Shale Oil |
| As ppm | 16 | 8 | 6.6 | 4.7 | <0.01 | <0.01 | 0.01 | 0.03 |
| Fe ppm | 52 | 38 | <3 | <3 | <3 | <3 | <3 | <3 |
| $C_7$ Insolubles % | 0.99 | 1.49 | 0.48 | 0.03 | 0.006 | 0.006 | 0.042 | 0.045 |
| Ramsbottom Carbon % | 1.60 | 3.05 | 0.32 | 0.32 | 0.08 | 0.05 | 0.13 | 0.32 |
| S % | 0.57 | 0.55 | 0.51 | 0.50 | 0.009 | 0.014 | 0.026 | 0.036 |
| N % | 2.14 | 2.18 | 1.95 | 1.84 | 0.175 | 0.116 | 0.395 | 0.600 |
| $k_N$ Nitrogen Removal Rate Const., $hr^{-1}$* | | 2.42 | 1.8 | 4.02 | 4.37 | | | |
| End Pt. of Coker Distillate, °C. | | | 469 | 460 | | | | |
| Yield of Coker Distillate, % | | | 88.7 | 88.0 | | | | |
| Yield of Coke % | | | 7.6 | 8.4 | | | | |
| Calc. As in Coke, ppm | | | | 134 | 46 | | | |
| Calc. Fe in Coke, ppm | | | | 684 | 452 | | | |

*Based upon hydroprocessing over a Ni-Mo-Ti on $SiO_2$-$Al_2O_3$ catalyst at 416° C. (780° F.), 143 atm $H_2$ gauge (2100 psig), LHSV=1 and 2492 volumes $H_2$ per volume of oil.

TABLE II

| Feedstock | | Thermal Dearsenation | | | | Product | |
|---|---|---|---|---|---|---|---|
| As ppmw | Fe ppmw | Temp, °C. | Pressure, Abs | LHSV | Contact Material | As ppmw | Fe ppmw |
| | | Oil From Colorado Oil Shale A, Indirectly Heated Retorting | | | | | |
| 33 | | 177 | 1 atm, No $H_2$ | 0.5 | Carbon Particles, 1 mm size | 12 | |
| 25 | 69 | 349 | 1 atm, No $H_2$ | 1.0 | Carbon Particles, 1 mm size | 15 | 37 |
| 25 | 69 | 382 | 1 atm, No $H_2$ | 1.0 | Carbon Particles, 1 mm size | 18 | 39 |
| 25 | 69 | 416 | $H_2$, 69 atm | 1.0 | Carbon Particles, 1 mm size | 4 | 28 |
| 22 | | 399 | $H_2$, 69 atm | 1.0 | Carbon Particles, 1 mm size | 2.2 | |
| 22 | | 399 | $H_2$, 69 atm | 4.0 | Carbon Particles, 1 mm size | 5 | |
| 21 | 60 | 399 | 1 atm, No $H_2$ | 1.0 | Carbon Particles, 1 mm size | 11 | 22 |
| 20 | | 399 | 1 atm, No $H_2$ | 0.5 | Neutral Alumina, 1 mm size | 13 | |
| 20 | | 399 | 1 atm, No. $H_2$ | 0.25 | Neutral Alumina, 1 mm size | 5 | |
| 20 | | 399 | 1 atm, No $H_2$ | 1.0 | Neutral Alumina, 1 mm size | 14 | |
| 20 | | 399 | 1 atm, No $H_2$ | 16.0 | Neutral Alumina, 1 mm size | 15 | |
| 20 | | 343 | $H_2$, 69 atm | 0.5 | Neutral Alumina, 1 mm size | 13 | |
| 20 | | 399 | $H_2$, 69 | atm | 0.5 | Neutral Alumina, 1 mm size | 4 |
| 20 | | 427 | $H_2$, 69 atm | 0.5 | Neutral Aluina, 1 mm size | 2 | |
| 16 | | 393 | 1 atm, No $H_2$ | 1.0 | 1/16" Extruded Alumina | 9 | |
| 16 | | 399 | $N_2$, 14.6 | atm | 1.0 | 1/12" Extruded Carbon | 8 |
| 13 | | 399 | $H_2$, 69 atm | 0.5 | Neutral Alumina, 1 mm size | 3 | |
| | | Oil From Colorado Oil Shale B, Indirectly Heated Retoring | | | | | |
| 29 | | 371 | 1 atm, No $H_2$ | 1.0 | Carbon Particles, 1 mm size | 8 | |
| 29 | | 399 | $H_2$, 69 atm | 1.0 | Carbon Particles, 1 mm size | 1.5 | |
| | | Oil From Colorado Oil Shale A, Directly Heated Retorting | | | | | |
| 34 | | 399 | 1 atm, No $H_2$ | 1.0 | Carbon Particles, 1 mm size | 11 | |
| 34 | | 399 | $H_2$, 69 atm | 1.0 | Carbon Particles, 1 mm size | 3.6 | |

The results show that arsenic and iron removal increase with both increased time and temperature, until a certain range of arsenic remains—generally from 8 to 15 ppm when no $H_2$ is present, and, when $H_2$ is present, the lower end of the range extends to about 1 ppm. Iron, when present in the feed, is removed in the thermal dearsenation step, but the amount of iron removed is not affected as much by the presence of hydrogen as the amount of arsenic removal. The type of contact material does not appear to affect the amount of arsenic or iron removed.

What is claimed is:

1. A method for producing a hydroprocessed shale oil product from a shale oil feedstock contaminated with more than 4 ppmw arsenic in the form of at least one soluble arsenic compound, which comprises:

(a) forming an aged shale oil having an arsenic content lower than that of said feedstock by contacting said feedstock with a porous solid contact material at a temperature from 149° to 510° C. (300° to 950° F.), at a liquid hourly space velocity from 0.1 to 60 volumes of liquid per hour per volume of contact material, and a pressure sufficient to maintain said feedstock in substantially liquid phase, whereby a portion of said arsenic is deposited upon said contact material;

(b) forming a coker distillate having an arsenic content lower than that of said aged shale oil and an arsenic-containing coke by coking at least a portion of said aged shale oil; and (c) forming said shale oil product having less than 1 ppmw soluble arsenic and a higher hydrogen-to-carbon ratio than said feedstock by catalytically reacting at least a portion of said distillate from step (b) at an elevated temperature with hydrogen in the presence of a hydroprocessing catalyst.

2. The method of claim 1 wherein said aged shale oil is formed at a temperature of 149° to 427° C. (300° to 800° F.) and below the point of significant thermal decomposition.

3. The method of claim 1 wherein said aged shale oil is formed in the absence of added hydrogen.

4. The method of claim 1 where said aged shale oil is formed in the presence of hydrogen at a hydrogen partial pressure from 3.4 to 204 atm gauge (50 to 3000 psig).

5. The method of claim 1 wherein said contact material is non-catalytic with respect to arsenic removal.

6. The method of claim 1 wherein immediately prior to step (b), said aged shale oil is fractionated into a light distillate fraction and a heavy fraction which is said portion of aged shale oil which is coked in step (b).

7. The method of claim 1 wherein said shale oil feedstock contains at least 10 ppmw iron in the form of at least one soluble iron compound, in step (a), iron is deposited upon said contact material, in step (b) said coker distillate has a lower soluble iron content than said aged shale oil, and said shale oil product has less than 1 ppm soluble iron.

8. The method of claim 1 wherein said aged shale oil has a lower pour point than said shale oil feedstock.

* * * * *